United States Patent [19]

Reis

[11] 3,994,328

[45] Nov. 30, 1976

[54] REMOVABLE FLEXIBLE CARD PROTECTING FLAP FOR USE IN A CREDIT CARD BILLFOLD

[75] Inventor: John P. Reis, West Bend, Wis.

[73] Assignee: Amity Leather Products Company, West Bend, Wis.

[22] Filed: Sept. 8, 1975

[21] Appl. No.: 611,028

[52] U.S. Cl. ..... 150/35; 150/39

[51] Int. Cl.[2] ..... A45C 1/08

[58] Field of Search ..... 150/35, 39

[56] References Cited

UNITED STATES PATENTS

| | | | |
|---|---|---|---|
| 1,582,492 | 4/1926 | Tantlinger | 150/39 |
| 1,787,054 | 12/1930 | Scheuer | 150/35 |
| 2,226,976 | 12/1940 | Leaming | 150/39 |
| 2,476,739 | 7/1949 | Knee | 150/35 |
| 3,659,640 | 5/1972 | Fenster | 150/35 |
| 3,759,305 | 9/1973 | McIntyre | 150/39 |
| 3,777,795 | 12/1973 | Graetz | 150/39 |
| 3,946,781 | 3/1976 | Reis | 150/35 |

*Primary Examiner*—Ro E. Hart
*Attorney, Agent, or Firm*—James E. Nilles

[57] ABSTRACT

A billfold or wallet for carrying a plurality of credit cards or the like in readily accessible position including a removable folded flexible flap member protecting the cards. The wallet includes a plastic liner forming a plurality of separate pockets for receiving credit cards therein and a removable flexible flap covering the pockets in order to protect the credit cards located therein from abrasive wear and to prevent the credit cards from inadvertently slipping out of the wallet. The flexible flap is made from a thin, transparent plastic material so that the cards may be easily selected, and the flap is removably secured in such a manner as to facilitate its removal or insertion of a replacement flexible flap.

8 Claims, 6 Drawing Figures

REMOVABLE FLEXIBLE CARD PROTECTING FLAP FOR USE IN A CREDIT CARD BILLFOLD

BACKGROUND OF THE INVENTION

The present invention relates to multiple card wallets or billfolds which include means for holding a plurality of credit cards in an overlapping, shingled relationship. Such wallets or billfolds are shown for example, by the patent to Dengel, U.S. Pat. No. 3,856,036, issued Dec. 24, 1974. Multiple card wallets or billfolds have also been proposed wherein a flexible flap which covers the cards is held in overlapping, shingled relationship in separate pockets. The purpose of the flexible flap members is to prevent the cards from slipping out of the pocket. Wallets and billfolds of this type are illustrated by U.S. patent application Ser. No. 571,735, filed Apr. 25, 1975.

SUMMARY OF THE INVENTION

The present invention provides a wallet or billfold which includes at least one multiple pocket liner having a plurality of individual pockets for receiving credit cards in shingled relation and further includes an improvement by providing a removable flexible flap means to cover the cards positioned in the separate pockets. The flexible flap means of the invention includes an integrally attached folded portion which is receivable in the uppermost credit card pocket for supporting the flexible flap. The folded portion includes a second flap portion which extends upwardly and is received by one of the pocket walls to provide additional means to secure the removable flexible flap means in the wallet. The peripheral edges of the folded portion are also provided with notched projections to prevent inadvertent removal of the flexible flap member.

By providing a removable flexible flap which covers the cards received in the pocket, the cards are secured therein against inadvertent loss and are protected from accessive wear. Providing means for removal of the flexible flap permits easy replacement of the flexible flap if it is damaged or worn and also reduces the costs of assembly during the manufacturing process.

Further objects and advantages of the invention will become apparent with reference to the following description of the preferred embodiment.

DESCRIPTION OF THE PREFERRED EMBODIMENT

Figure 1:
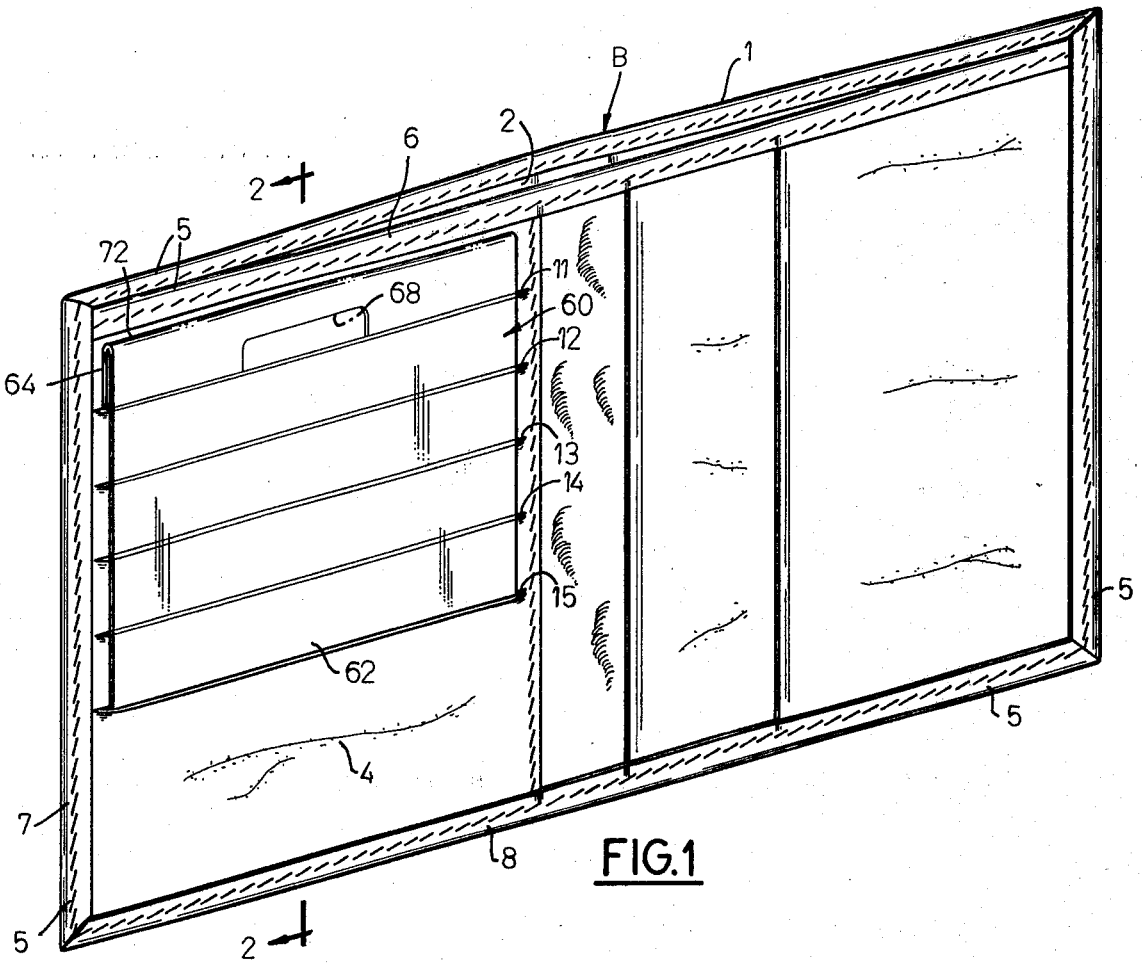
FIG. 1 is a perspective view of the billfold embodiment, the view being taken generally from the inside of the wallet.
Figure 3:
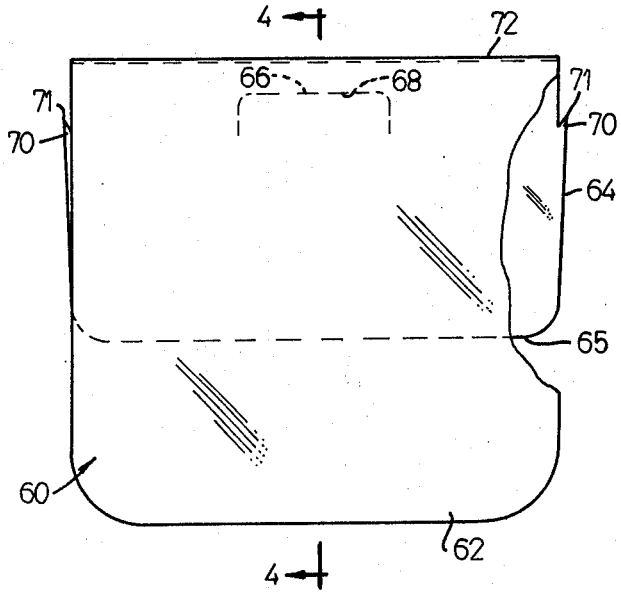
FIG. 3 is a front view of a removable plastic flexible flap made in accordance with the present invention.
Figure 4:
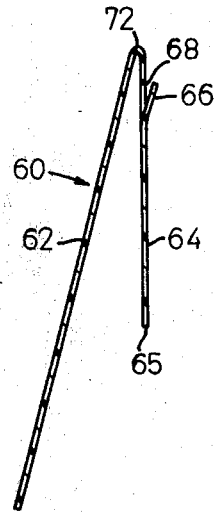
FIG. 4 is a sectional view taken along the line 4—4 in FIG. 3.
Figure 5:
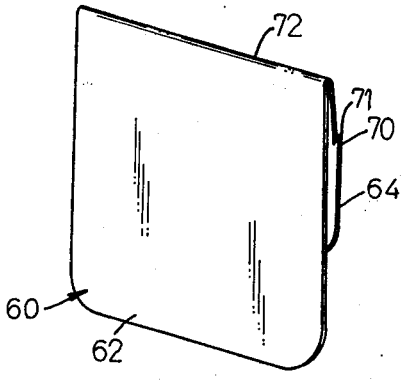
FIG. 5 is an isometric front view of the removable plastic flexible flap of the invention.
Figure 6:
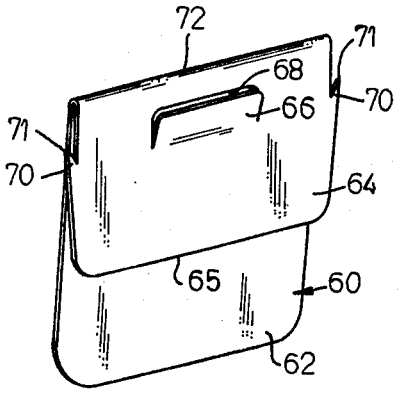
FIG. 6 is an isometric rear view of the removable plastic flexible flap of the invention.

The invention has been shown as embodied in a wallet or billfold B which is made generally from leather for example, and comprises an outside wall 1 lined with fabric 2, an inner flexible wall 3 which may be formed of fabric and another flexible wall 4, also formed of leather. It will be noted that the usual edging and stitching 5 is provided around the periphery. More specifically, the edging binds together the wall 1 and its lining 2 and also binds together the two flexible walls 3 and 4.

The flexible walls 3 and 4 are secured together by the binding 5 around the upper side 6, the vertical side 7 and the lower side 8, thus presenting an envelope-like opening 10 along its other vertical side, and more specifically, between the walls 3 and 4. It is in this opening that flat objects such as various papers, etc. can be stored.

The flexible wall 4 has a series of slits 11, 12, 13, 14 and 15 formed therein and arranged in parallelism with one another, and also being spaced a vertical distance apart, generally in the nature of ½ inch. It is in these slits that credit cards or the like can be inserted at least partially so as to extend therefrom and be readily found when in overlapping and shingled relationship with one another.

Figure 2:
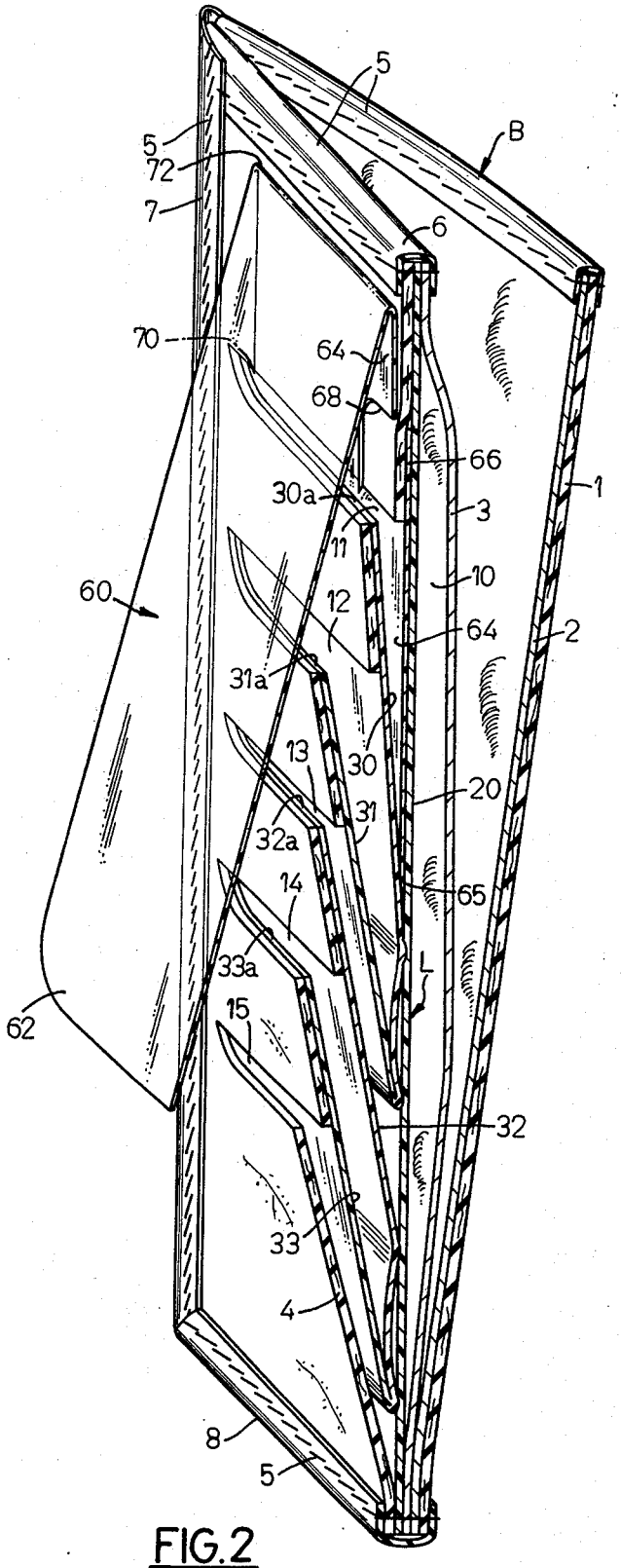
FIG. 2 is a cross-sectional view taken generally along the line 2—2 in FIG. 1 but on an enlarged scale and showing the individual pockets pulled outwardly to illustrate their construction.

A one piece, plastic multi-pocket liner L is received between the walls 3 and 4 to provide pockets for holding the credit cards placed in slits 11–15. The multi-pocket liner can be formed of heat sealable plastic, such as a 0.0042 inch thick matte finish polyvinyl. This one piece plastic liner L is comprised of a back member 20 of generally rectangular shape and four pocket members 30, 31, 32 and 33. Each of these pocket members has a generally rectangular shape and has an upper edge **30*a*, 31*a*, 32*a* and 33*a*, respectively. The pocket members are arranged or laid together in a stacked relationship and against the back member 20. The members are heat sealed together, for example, along their vertical edges and also along their bottom edges of each of the pocket members. The upper edges of the pockets 30–33 are arranged in overlapping and shingled relationship and are secured by cementing, for example, to the front wall 4 in such a manner that the pockets 30–33 and slits 11–15 are arranged, as shown in FIG. 2**, for reception of credit cards in overlapping and accessible relationship.

The billfold B of the present invention also includes a one piece removable flap member 60 which includes a front flexible flap 62 for covering the credit cards received in the slits 11–15. As shown in FIGS. 3–6, the removable flap member 60 is folded so as to define a generally rectangular front flexible flap 62 and a generally rectangular rear securing flap portion 64 which are integrally connected. The rear securing portion 64 is of a width substantially the same as the width of the slits 11–15 and is receivable through the slit 11 so as to be received in the uppermost pocket 30 as shown in FIG. 2. The rear securing portion 64 also includes an upwardly extending tab 66 which can be received between the front wall 4 and the rear wall 20.

The upwardly extending tab 66 is formed by a broad generally U-shaped cut 68 in the rear securing portion 64 which permits the upwardly extending tab 66 to be received behind the front wall 4 when the removable flap member 60 is received within pocket 30. The generally U-shaped cut 68 is located in the rear securing flap portion 64 such that the tab 66 bends along a line closely adjacent to the slit 11. The rear securing portion 64 also includes a pair of outwardly extending notched wing members 70 projecting generally upwardly from each of its sides. The wing members 70 are located such that when the removable flap member 60 is placed in pocket 30, the upwardly extending ends 71 of the wing members 70 can be received behind the front wall 4 at the opposite ends of the slit 11. As shown in FIG. 2, the bottom edge 65 of the rear portion 64 is received in the bottom portion of pocket 30, and the tab 66 and wing members 70 prevent upward movement of the removable flap member 60 in the pocket 30. The flap member 60 is thus secured against movement in the pocket 30.

It is generally desirable to construct the folded removable flap member 60 from a thin transparent plastic material such as dry vinyl or polyvinyl which does not obscure the view of the cards. The transparent material may be on the order of 0.010 inches thick to provide the desired strength but to remain relatively flexible. Material comprising dry vinyl and polyvinyl of this thickness also facilitates the creation of the permanent crease or fold 72. Of course, the flexible member 60 may also be constructed of other suitable types of flexible materials including other types of plastics, leather or fabrics.

One of the primary functions of the folded removable flexible member 60 is to prevent the credit cards which may be received in the pockets 30, from inadvertently slipping out of the pockets. As shown in FIG. 1, the front flexible flap 62 may be tucked into the lower slit 15 and may be pulled flat aginst the credit cards received in each of the slits 11–15. The flexible member also functions to prevent abrasive wear of the cards since it completely covers the exposed portion of the cards.

By providing the removable flap member 60 with means for permitting relatively easy insertion or removal of the member, the costs of manufacturing the wallet or billfold are substantially reduced and it is also possible for the user to replace the flap member in the event that it becomes worn or damaged. It is particularly desirable that the flap member 60 be removable because the material used to make the flap is generally not as durable as the material comprising the rest of the wallet. For example, the flexible plastic material may be scratched or cracked after continued use to the point where it is desirable to replace the flap member. By providing means to permit easy removal of the flexible flap, the utility and useful life of the wallet or billfold is greatly increased.

I claim as my invention:

1. A one piece removable flexible flap member for use in a wallet or billfold having a plurality of vertically disposed pockets for receiving credit cards in stacked, shingled and partially exposed relationship, said wallet or billfold including at least one flexible wall having a plurality of parallel and spaced apart slits therein for defining said pockets, said flap member comprising a front flap portion for liftably covering the credit cards projecting from said pockets and a rear flap portion integrally joined in folded relationship to said front flap portion, wherein said rear flap portion extends downwardly through one of said slits for supporting said front flap portion, said rear flap portion including an integrally connected upwardly extending tab removably received behind said front wall for removably securing said flap member in said pocket.

2. The one piece removable flexible flap member set forth in claim 1, wherein said rear flap portion is generally rectangular and includes vertically extending sides, said sides including outwardly and upwardly extending wings projecting therefrom and removably received behind said front wall for securing said flap member in said pocket.

3. The one piece removable flexible flap member set forth in claim 2, wherein said sides taper upwardly and outwardly, each of said tapering sides including an outwardly and upwardly extending pointed projection defining said wings.

4. The flexible flap member set forth in claim 1, wherein said rear flexible flap portion is received in the uppermost of said vertically disposed slits and wherein said front flap portion extends downwardly to cover credit cards received in each of said pockets and wherein said front flap portion can be tucked into the lowermost of said slits.

5. A one piece removable flexible flap member for use in a wallet or billfold having a plurality of vertically disposed pockets for receiving credit cards in stacked, shingled and partially exposed relationship, said wallet or billfold including at least one flexible wall having a plurality of parallel and spaced apart slits therein for defining said pockets, said flap member comprising a front flap portion for liftably covering the credit cards projecting from said pockets and a rear flap portion integrally joined in folded relationship to said front flap portion, wherein said rear flap portion extends downwardly through one of said slits for supporting said front flap portion, said rear flap portion including vertically extending sides, each of said sides including an outwardly and upwardly extending pointed projection, said pointed projections received behind said front wall at opposite ends of said slits for removably securing said flap member in said pocket.

6. A multi-pocket billfold of the type for carrying a plurality of cards in shingled and partially exposed relationship, said billfold comprising at least one flexible wall having a plurality of parallel and spaced apart slits therein, a plurality of pockets disposed adjacent to and behind said flexible wall for receiving said cards through said slits in stacked, shingled relationship, and a removable flexible flap member for covering said cards to protect said cards from wear and to prevent them from slipping out of said pockets, said removable flexible flap member removably received in one of said pockets and including a tab received behind said one flexible wall for securing said flap member in said pockets, said flap member liftably covering the front surface of said front flexible wall to cover cards projecting from said respective slits for securing said cards in said pockets.

7. The billfold set forth in claim 6, wherein said flexible flap member includes a front flap portion and an integrally attached rear flap portion, said flap portions being connected in folded relationship, said rear flap portion being received in one of said pockets and said front flap portion liftably covering said cards.

8. The billfold set forth in claim 7, wherein said rear flap portion includes said tab and further includes outwardly and upwardly extending wings projecting from the sides of said portion, said tab and said wings removably securing said flap member in said pocket.

* * * * *